United States Patent [19]

Durbin

[11] 4,324,312

[45] Apr. 13, 1982

[54] DIAPHRAGM SUSPENSION CONSTRUCTION

[75] Inventor: Howard M. Durbin, Tarzana, Calif.

[73] Assignee: James B. Lansing Sound, Inc., Northridge, Calif.

[21] Appl. No.: 80,473

[22] Filed: Oct. 1, 1979

Related U.S. Application Data

[63] Continuation-in-part of Ser. No. 960,597, Nov. 14, 1978, abandoned.

[51] Int. Cl.[3] ..... H04R 7/00

[52] U.S. Cl. ..... 181/171; 181/173

[58] Field of Search ..... 181/167, 171-173

[56] References Cited

U.S. PATENT DOCUMENTS

| | | | |
|---|---|---|---|
| 1,829,355 | 10/1931 | Houghton | 181/173 |
| 2,923,371 | 2/1960 | Otto | 181/173 |
| 3,563,337 | 2/1971 | Kawamura | 181/173 |

FOREIGN PATENT DOCUMENTS

| | | | |
|---|---|---|---|
| 548807 | 4/1932 | Fed. Rep. of Germany | 181/172 |
| 368926 | 3/1932 | United Kingdom | 181/172 |
| 726780 | 3/1955 | United Kingdom . | |

OTHER PUBLICATIONS

Hitachi Technology Bulletin No. 60, *Electroacoustic Transducer,* Ref. No. 10599-K(60).

Hitachi Product News, *Gathered-Edge Suspension,* Hitachi, Ltd., Tokyo, Japan, Catalog No. HE-E262.

*Primary Examiner*—L. T. Hix
*Assistant Examiner*—Benjamin R. Fuller
*Attorney, Agent, or Firm*—Lyon & Lyon

[57] ABSTRACT

An annular suspension for supporting an acoustic diaphragm around its edge and permitting axial diaphragm movement. The suspension is made of thin folded sheet material, such as aluminum, and includes inner and outer concentric circular fold lines having a series of pyramid-like structures therebetween to control anti-nodal resonance of the suspension independently of the desired first resonance. The suspension may be formed integrally with the diaphragm, which may be of the dome or cone configuration and is provided with a conventional voice coil. The suspension permits axial diaphragm movement by slight flexing at the fold lines, minimizing stretching of the sheet material and preventing torsional movement of the diaphragm. When the suspension is at rest, the inner and outer circular fold lines desirably lie in a common plane normal to the diaphragm axis and the pyramid-like structures project alternately on each side of that plane. During operation, the circular fold line adjacent to the diaphragm moves slightly from that plane, and the pyramid-like structures flatten slightly.

12 Claims, 12 Drawing Figures

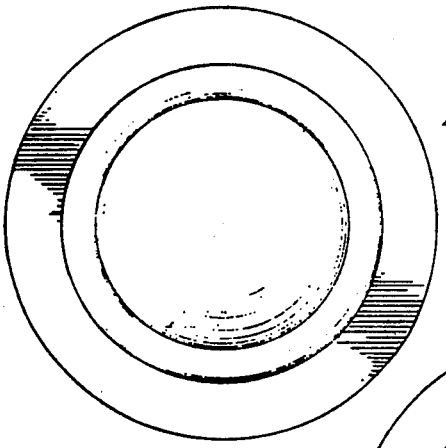
FIG. 10.
PRIOR ART
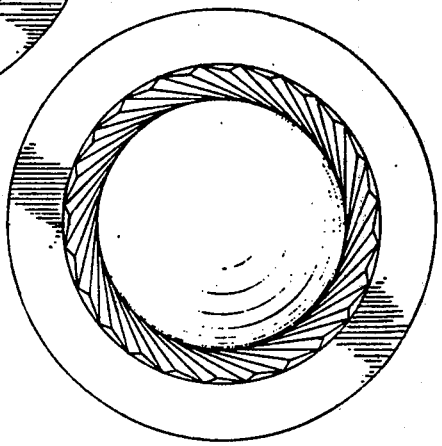
FIG. 11.
PRIOR ART
FIG. 12.
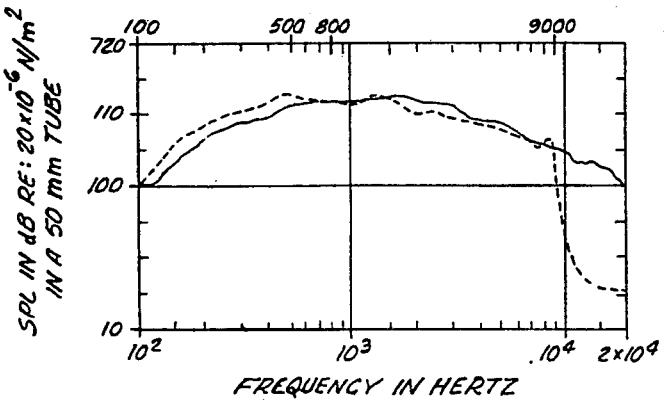

DIAPHRAGM SUSPENSION CONSTRUCTION

RELATED APPLICATION

This application is a continuation-in-part of Ser. No. 960,597, filed Nov. 14, 1978, now abandoned.

BACKGROUND AND FIELD OF THE INVENTION

This invention relates generally to the mounting of acoustic diaphragms in loudspeakers, microphones or the like, and more particularly to an annular suspension for supporting the outer and/or inner edge portion of an acoustic diaphragm and permitting axial but not torsional movement of the diaphragm relative to a fixed support frame to which the suspension is attached.

Prior suspensions, sometimes referred to as compliances or surrounds, have been used for supporting acoustic diaphragms, exemplified by the constructions shown in U.S. Pat. No. 1,829,355 to Houghton and U.S. Pat. No. 3,563,337 to Kawamura, and by FIGS. 10 and 11 of the drawings presented herewith as examples of other forms of suspensions. The principal objectives of such constructions, as well as of the present invention, are to prevent torsional or radial movement of the diaphragm while permitting axial movement thereof, and to minimize stress of the material of which the suspension is made, whereby to provide for long life of the suspension and to avoid distortion by permitting the diaphragm to move as nearly as possible in accurate response to the signal in the voice coil.

The two patents exemplify the state of the art as to folded surrounds and have as their principal objective the control of the low frequency end of the given transducer's frequency response. They further seek to solve the problems of achieving a large excursion without over-stressing the material or otherwise distorting its shape so as to minimize distortion of the acoustic output, to prolong the operating life, and to improve the frequency response particularly at this low, high excursion, end of their desired range.

The present invention, on the other hand, without substantially altering the behavior at the low frequency end of the transducer's range, is concerned with the first anti-nodal and second nodal resonances which together with the moving mass mark the high frequency end of this range. This invention makes possible for the first time the independent control of the high and low ends of the range.

SUMMARY OF THE INVENTION

In the present invention, the above objectives are achieved by providing a suspension of thin folded sheet material such as aluminum in the form of an annulus consisting of a series of pyramid-like structures one marginal portion of the annulus extending continuously along and fixed to an edge of the diaphragm, and the other marginal portion of the annulus being fixed to a support member such as a conventional hollow frame. Each of the structures extends over no more than about 15° of arc, and hence the bases of the pyramids may be considered to be approximately trapezoidal even though each base is bounded inwardly and outwardly by arcuate fold lines formed in the sheet material, and laterally by fold lines lying in planes extending radially of the diaphragm. The outer and inner faces of each pyramid are triangular, and the lateral faces of each are made up of a pair of smaller triangular facets bisected by a central fold line intermediate the inner and outer circular fold lines and concentric therewith.

Axial excursion of the diaphragm in response to the voice coil signal causes flexing of the fold lines above described, as distinguished from stretching of the suspension material itself in other prior designs. It is thus a principal object of the invention to provide a novel suspension for an acoustic diaphragm wherein diaphragm movement causes slight flexing of fold lines formed in thin foldable sheet material. Other objects and purposes are to provide such a suspension for a diaphragm having a circular edge and including inner and outer circular fold lines and a third circular fold line intermediate the inner and outer lines; to provide such a suspension including a series of pyramid-like structures formed in the sheet material of the suspension, with the apices of the pyramids located on the intermediate circular fold line; to provide such a suspension wherein the sides of the generally trapezoidal bases of the pyramids lie on short arcs of the inner and outer circular fold lines and on lines in planes generally radial of the diaphragm; and for other and additional purposes as will be understood from a reading of the following description of an illustrative embodiment of the invention taken in connection with the accompanying drawings.

BRIEF DESCRIPTION OF THE DRAWINGS

FIGS. 10 and 11 are examples of prior art surrounds.

FIG. 12 is a graphic representation showing the response of the present invention and that of the prior art.

DETAILED DESCRIPTION

Figure 1:
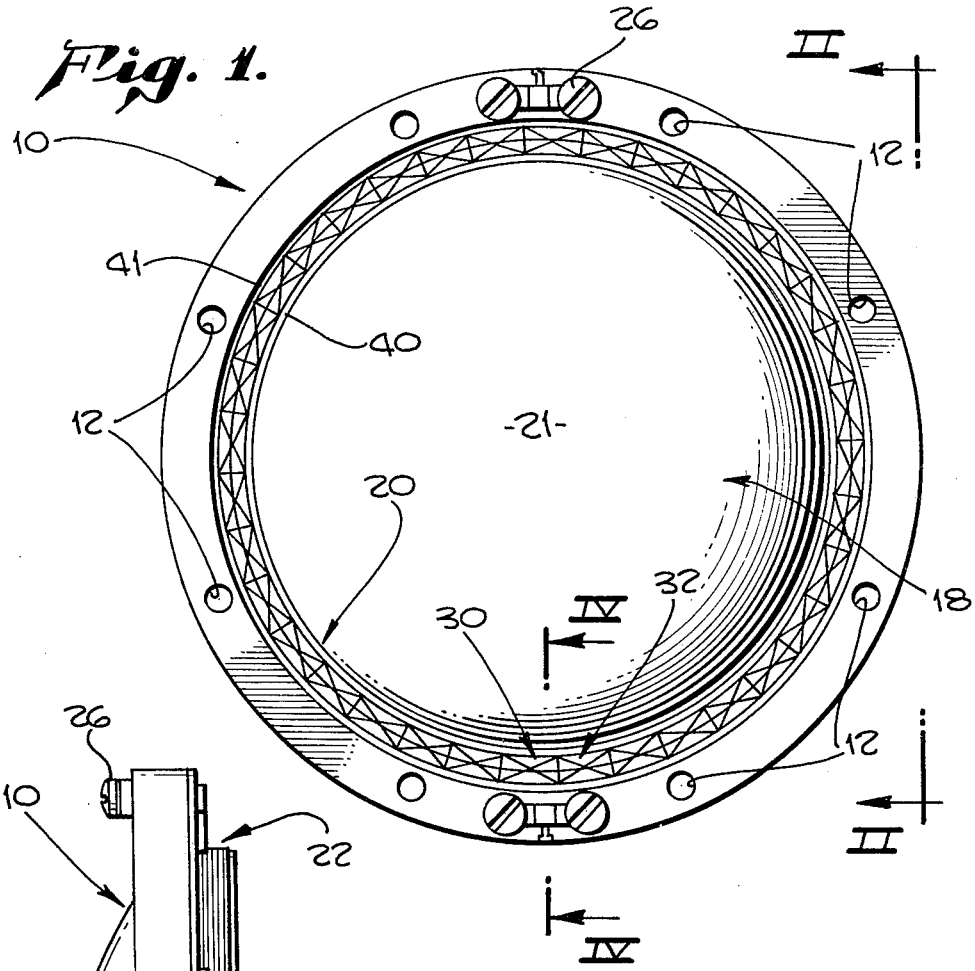
FIG. 1 is a rear view of a diaphragm assembly embodying a suspension of the present invention in which each pyramid-like structure extends 10° of arc.
Figure 2:
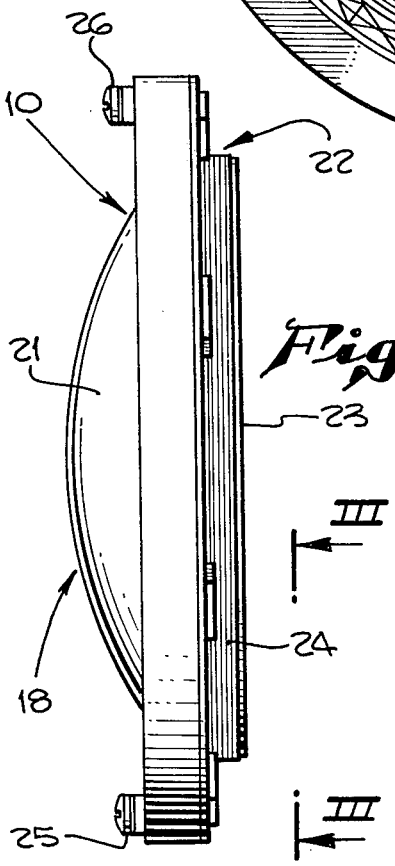
FIG. 2 is a side elevational view taken on arrows II—II of FIG. 1.

Referring in detail to FIGS. 1 and 2, a hollow annular frame or rigid material, typically dielectric, is indicated generally at 10 and is provided with a set of mounting holes 12, here illustratively eight in number, arcuately spaced about the frame. In the present form of the invention, the diaphragm and its suspension are formed integrally of thin sheet aluminum, the dome diaphragm being indicated generally at 18 and the annular suspension being indicated generally at 20. The dome itself is specifically indicated at 21. Radially inwardly of the suspension is a conventional voice coil assembly indicated generally at 22 fixed to the diaphragm, including a bobbin 23 and the voice coil proper 24, connected to terminals 25 and 26. Radially outwardly of suspension 20 and formed integrally therewith is an annular skirt portion 28, best seen in FIG. 4, by which the diaphragm and its suspension are fixedly attached to frame 10 by suitable adhesives and clamping rights well known in the art. It will be understood that all the constructions and elements thus far identified, except suspension 20, are conventional and well known in the loudspeaker art.

As best seen in FIG. 1, suspension 20 is formed to provide a series of identical structures extending circumferentially about the periphery of dome 21. Each of the structures in pyramid-like in configuration. In the embodiment shown in FIG. 1, there are 36 such structures and each therefore extends through 10° of arc. For reasons later appearing, it is preferred in the present invention that the arcuate extent of each modular structure not exceed about 15°.

Figure 3:
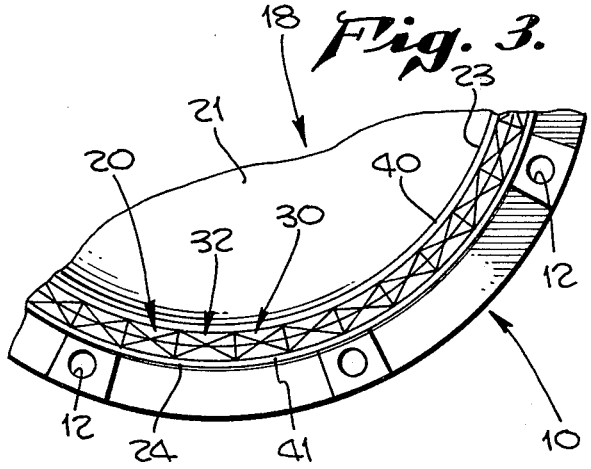
FIG. 3 is a fragmentary front view taken on arrows III—III of FIG. 2.

In suspension 20, two adjacent structures 30 and 32 will be described in detail, keeping in mind that FIGS. 1 and 5 look forwardly, while FIG. 3 looks rearwardly.

Figure 8:
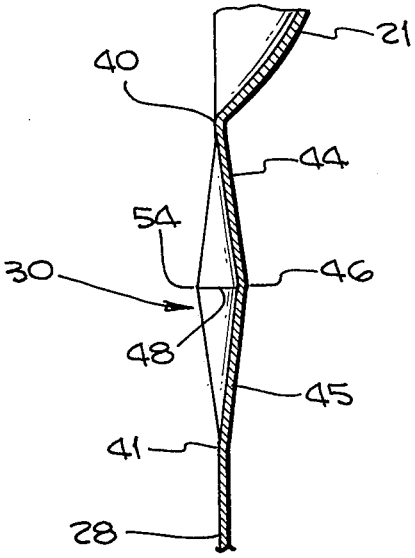

It will be seen that the bases of structures 30 and 32 are approximately trapezoidal in shape, being bounded inwardly and outwardly by arcs of circular fold lines 40 and 41, respectively, and bounded laterally by fold lines which lie in planes extending radially of the diaphragm. Each lateral boundary is made up of two line segments which, as seen in section in FIG. 8, are angularly related. More specifically, the lateral fold line seen in FIG. 8 includes segments 44 and 45, which are inclined forwardly from inner and outer circular fold lines 40 and 41, respectively. Segments 44 and 45 meet at a point 46 which lies on a circular fold line 48 disposed intermediate the inner and outer circular fold lines 40 and 41.

Figure 5:
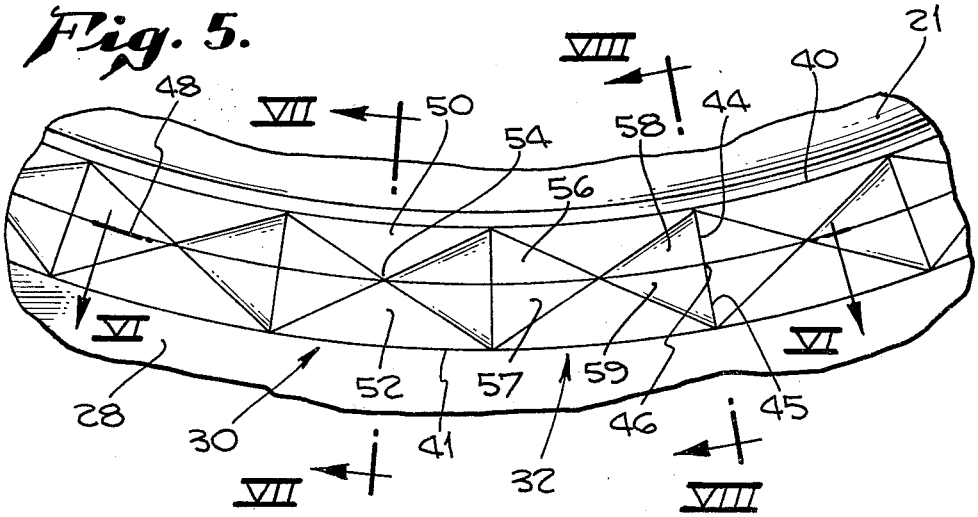
FIG. 5 is a fragmentary view on an enlarged scale looking forwardly on arrows V—V of FIG. 4.
Figure 6:
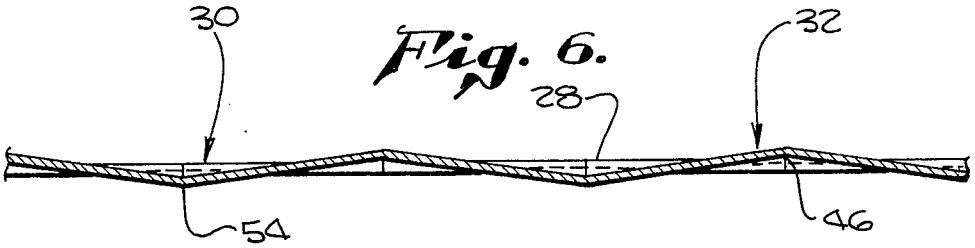
FIGS. 6, 7 and 8 are sectional views taken, respectively, on arrows VI—VI, VII—VII and VIII—VIII of FIG. 5.
Figure 7:
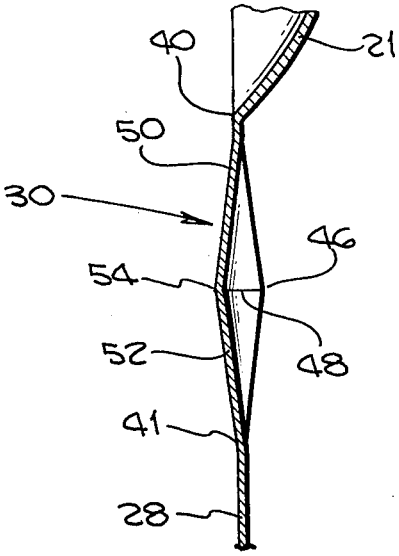

With reference to FIGS. 5 and 7, pyramid-like structure 30 includes triangular faces 50 and 52, the apices of the faces meeting at a common point 54 lying on intermediate fold line 48; in FIG. 6, the lateral faces of structure 32 are approximately bisected by fold line 48, forming facets 56, 57 and 58, 59 which create slightly concave dihedral angles along line 48.

Figure 4:
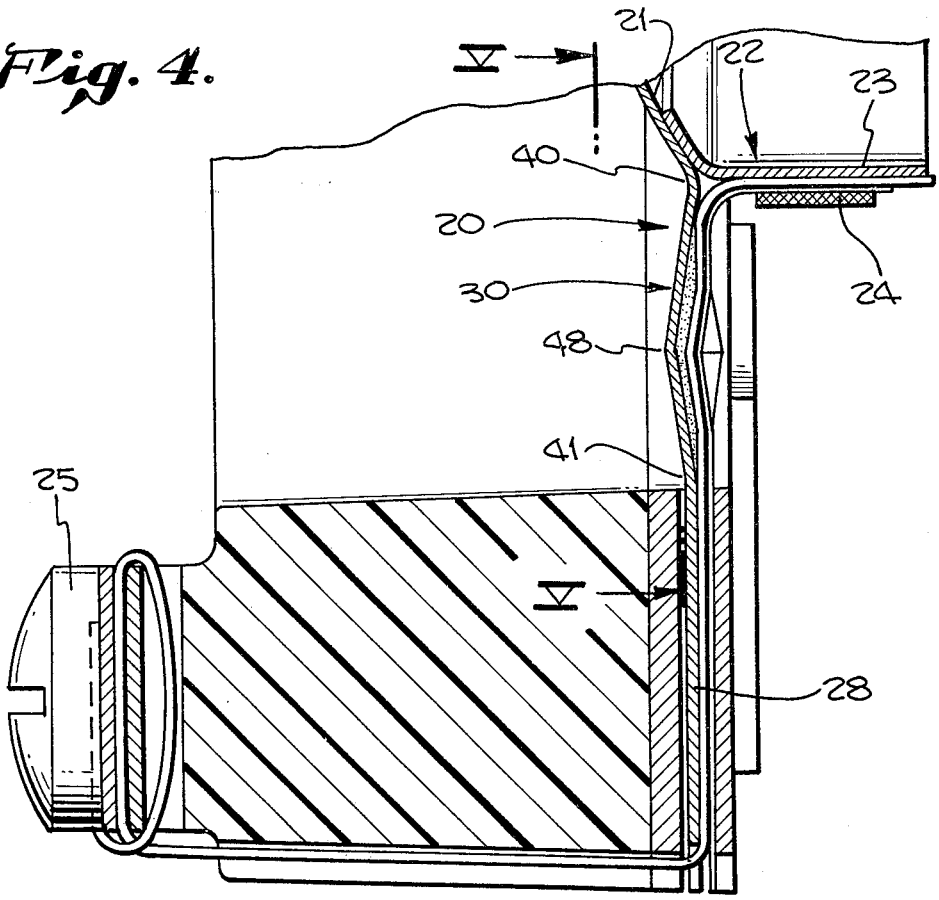
FIG. 4 is a fragmentary view on a greatly enlarged scale, taken on arrows IV—IV of FIG. 1.

With the parts at rest, the inner and outer circular fold lines 40, 41 lie in a common plane perpendicular to the diaphragm axis, as clearly appears in the drawings, particularly FIGS. 4, 7 and 8. The intermediate fold line, on the other hand, following as it does the apices of adjacent structures 30 and 32, for example, traverses this common plane alternately. A signal applied to the voice coil 24 will cause the inner circular fold line 40 to move leftwardly and rightwardly as seen in those Figures, and this movement is accommodated by the present suspension by slight flexing of the several fold lines, and with minimum stretching of the sheet material of which the suspension is made. The Pyramid-like structures flatten slightly as the fold line 40 moves.

Figure 9:
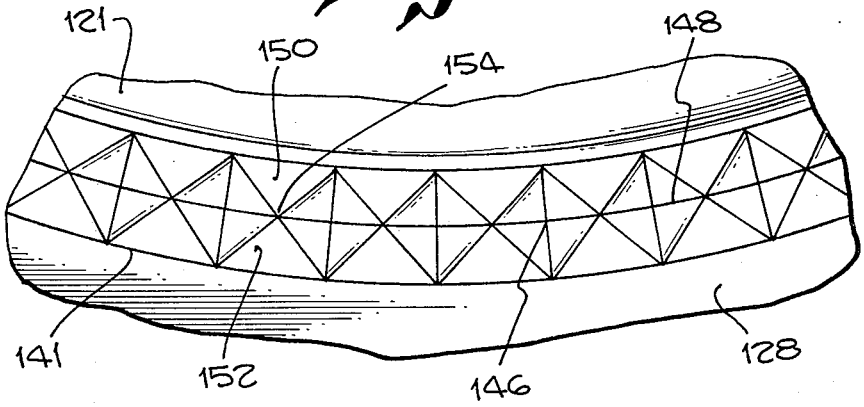
FIG. 9 is a fragmentary view of a suspension in accordance with the invention on which each pyramid-like structure extends only 5° of arc.

The bases of the pyramids are, of course, not true trapezoids in the geometric sense, but they approach that shape as the arcuate extent of each module is decreased, so that the arc approaches closer to a chord lying in a straight line, to facilitate the flexing or bending along the fold lines during opration. An arcuate extent of more than about 15° would unduly inhibit that bending. The form of the invention so far described includes 36 modules, each of 10° of arc. In FIG. 9 is shown a fragmentary portion of a suspension in accordance with the invention having 72 modules, each extending 5° of arc, certain structural features being indicated by reference numerals 100 greater than corresponding features in FIG. 5.

The geometric configurations of the present suspension facilitate diaphragm movement in the axial direction while providing enhanced stiffness in other directions, thus minimizing the possibility of partial or full cancellation occurring within the portion of the frequency spectrum of interest.

The diaphragm suspension of the present invention finds particular application in acoustic transducers operated in the middle to upper audio-frequency ranges. Diaphragm excursions for such transducers are typically small, but true axial travel without stretching or torsion is essential. So is a suspension which does not resonate in such a manner as to cancel the desired excursions of the diaphragm as driven by the voice coil. As will hereinafter be described, the suspension of the present invention achieves an improved stiffness-to-weight ratio which effectively moves the second resonance frequency of the suspension up substantially while not materially affecting the first resonance frequency. One of the specific applications of a suspension of the present type is in what are known as compression drivers which typically operate in a range from about 500 up to or beyond 20,000 Hz. In the past, such transducers have employed various types of suspension constructions, such as a solid annular half roll, as shown in FIG. 10, or what is generally known in the trade as the tangential surround, a folded material suspension as shown in FIG. 11 of the drawings. The tangential arrangement has been in general use since about the 1930's in compression drivers, microphones and the like.

Both the annular roll and the tangential surround have several critical disadvantages. Typically, frequency response of the former drops sharply at about 8–9 kHz. This has sometimes been solved by the use of somewhat exotic materials such as beryllium or alloys of titanium, which have a high modulus-to-weight ratio. These materials are not only expensive, but also difficult to use and to process, resulting in substantial manufacturing costs per unit. Additionally, these constructions, including some of those using the more exotic materials, have a relatively short operating life. Mechanical modifications to state-of-the-art surrounds such as thin middle sections and the like, often further sacrifice operating life for increased performance. Cracking of these suspensions due to apparent fatigue, heat stress, molecular-bond fatigue or other causes is a not infrequent failure mode.

The diaphragm of the present invention, typically utilizing a thin sheet of aluminum, for example, of 50 to 75 μm thickness can be easily formed in less than a second by pressure and appropriately formed dies. Thusly embossing it with the "pyramid pattern" surround hereinabove described, the frequency response is found to be extended at the upper end for about one full octave. In FIG. 12, power response curves for the annular roll surround and the present invention are compared utilizing the same material. The annular roll surround response is shown in the dotted line. Where the annuar roll surround cuts off drastically at about 8,000–9,000 Hz, the present invention does not, but rather continues to beyond 20 kHz, at which point it is only about −13 dB from maximum.

Even more significant, perhaps, than the better response is the operating life improvement. Initial life tests comparing this to the conventional tangential surround indicate an increase in operating life in excess of ten times and perhaps more than 100 times.

It is theorized that these benefits have been achieved (while using an inexpensive and normally rather low strength material) due to the unique "pyramid pattern" hereinabove described which mechanically provides a high stiffness-to-weight structure. If the surround be analogized to a one dimensional simple beam model, where one end is fixed and the other end is free, the reversing pyramid pattern provides a complex beam of greatest rigidity toward the center. The result is a support that has a substantially reduced anti-nodal resonance. By that it is meant that the free end (which actually is coupled to the moving diaphragm) will not reach a frequency of anti-resonance where it is out of phase with the drive frequency of the voice coil, at least not below the desired high cutoff frequency, nominally 20 kHz.

The suspension of the present invention is described as having the general shape of an annulus, and some of the fold lines are said to extend radially from the central axis of the diaphragm. However, it is to be understood that the words "annulus" and "radially" and their derivatives are used herein to refer to features of a border extending along a margin or edge of a diaphragm of any usable shape, not limited to circular, but including ellipsoidal, polygonal and combinations of such shapes.

The present suspension may be formed integrally with the diaphragm and the outer skirt, as shown and described herein, or it may be made as a separate annular element and attached to a diaphragm and skirt by suitable means or adhesives. It may be made of impregnated fabrics such as cloth, paper or fiberglass, or of other formable material such as suitable thermosetting or thermoplastic compositions and laminated materials. It is believed, however, that thin aluminum sheet provides the best material for most applications. Other modifications are also within the contemplation of the invention, and are intended to be embraced within the scope of the following claims.

I claim:

1. A suspension for loudspeakers, microphones or the like extending between an edge of a movable acoustic diaphragm and a fixed supporting member, comprising:

an annulus of thin sheet material, means providing said annular material with increased resistance to acoustic distortion, said means for stiffening said annulus material against flexing in a direction perpendicular to the plane of said annulus, said stiffening means operative to substantially increase the effective frequency at which anti-nodal resonance of the suspension annulus occurs.

2. A suspension of the type described in claim 1, wherein said stiffening means comprises a plurality of folded portions forming projecting subportions of said sheet material.

3. A suspension for loudspeakers, microphones or the like extending between an edge of a movable acoustic diaphragm and a fixed supporting member, comprising:

an annulus of thin sheet material, means providing increased stiffness for the intermediate portion of said annulus against flexing of said annulus in a direction perpendicular to the plane of said annulus, said means comprising a plurality of folds forming projecting subportions of said sheet material.

4. A suspension of the type described in claim 3, wherein the projecting subportions of said sheet material form pyramid-like structures projecting alternately in opposite directions from a common plane of said sheet material, said plane defined by the edge of said supporting member and the edge of the acoustic diaphragm when at rest.

5. A suspension for loudspeaker, microphones or the like extending between an edge of a movable acoustic diaphragm and a fixed supporting member, comprising:

an annulus of thin sheet material, said sheet having a plurality of fold lines therein extending concentrically, radially and laterally, said fold lines forming pyramid-like structures in said annulus, said pyramid-like structures projecting alternately in opposite directions from a plane defined by the edge of said supporting member and the edge of said diaphragm when at rest, said pyramid-like structures providing increased stiffness to the central portion of said annular sheet material.

6. A suspension for loudspeaker, microphones or the like extending between an edge of an acoustic diaphragm and a fixed supporting member comprising:

an annulus of thin foldable sheet material including inner and outer concentric fold lines formed in the material and consisting of a series of arcuately spaced pyramid-like structures, each structure having an approximately trapezoidal base defined by a first pair of opposed sides lying along said fold lines and by a second pair of opposed sides lying along fold lines which lie in planes extending radially of the axis, said material having formed therein a third concentric fold line intermediate said inner and outer fold lines.

7. The invention as defined in claims 4, 5 or 6, wherein said diaphragm and suspension are formed integrally.

8. The invention as defined in claim 7, wherein said diaphragm and suspension are formed of thin sheet metal.

9. The invention as defined in claim 7 wherein said diaphragm and suspension are formed of impregnated fabric material.

10. The invention as set forth in claim 7 wherein said diaphragm and suspension are formed of a material selected from the group consisting of thin sheet metal, impregnated fabric, thermosetting compositions, thermoplastic compositions and laminated materials.

11. The invention as defined in claim 6 wherein the annulus includes at least 24 of said structures.

12. The invention as defined in claim 6 wherein said inner and outer fold lines lie in a common plane perpendicular to the diaphragm axis.

* * * * *